US007073362B2

(12) United States Patent
Baensch

(10) Patent No.: US 7,073,362 B2
(45) Date of Patent: Jul. 11, 2006

(54) DRIVE FOR COLD PILGER ROLLING STAND

(75) Inventor: Michael Baensch, Mönchengladbach (DE)

(73) Assignee: SMS Meer GmbH, Monchengladbach (DE)

( * ) Notice: Subject to any disclaimer, the term of this patent is extended or adjusted under 35 U.S.C. 154(b) by 242 days.

(21) Appl. No.: 10/656,583

(22) Filed: Sep. 5, 2003

(65) Prior Publication Data

US 2004/0045334 A1 Mar. 11, 2004

(30) Foreign Application Priority Data

Sep. 7, 2002 (DE) ..... 102 41 612

(51) Int. Cl.
*B21D 7/02* (2006.01)

(52) U.S. Cl. ..... 72/214; 249/450

(58) Field of Classification Search ..... 72/249, 72/214, 450

See application file for complete search history.

(56) References Cited

U.S. PATENT DOCUMENTS

| | | | | |
|---|---|---|---|---|
| 4,386,512 | A * | 6/1983 | Rehag et al. | 72/214 |
| 4,858,458 | A | 8/1989 | Gerretz | |
| 5,076,088 | A | 12/1991 | Klingen | |
| 5,224,369 | A * | 7/1993 | Rehag et al. | 72/214 |
| 5,540,076 | A | 7/1996 | Baensch | |
| 5,916,320 | A * | 6/1999 | Stinnertz et al. | 72/214 |

FOREIGN PATENT DOCUMENTS

| | | |
|---|---|---|
| DE | 962 062 | 4/1957 |
| DE | 36 13 036 | 8/1987 |

* cited by examiner

*Primary Examiner*—Dmitry Suhol
(74) *Attorney, Agent, or Firm*—Andrew Wilford

(57) ABSTRACT

A drive for reciprocating a roll stand of a pilger cold-rolling system has a crank rotatable about an axis transverse to a reciprocation direction of the stand and a tie rod having an outer end journaled on the stand and an inner end eccentrically journaled on the crank so that rotation of the crank reciprocates the stand in the direction. A compensating weight is fixed to the crank opposite the tie rod and orbits in a weight plane on rotation of the crank. A counterweight is offset along the weight plane from the crank. A drive connects the counterweight to the crank for orbiting the counterweight in the weight plane on rotation of the crank.

13 Claims, 5 Drawing Sheets

DRIVE FOR COLD PILGER ROLLING STAND

FIELD OF THE INVENTION

The present invention relates to a drive for a cold pilger rolling stand. More particularly this invention concerns such a drive that reciprocates the roller bearing on the hollow advancing workpiece.

BACKGROUND OF THE INVENTION

In cold pilger rolling a hollow billet is advanced in a rolling direction over a generally stationary mandrel while a pair of rolls squeeze the billet against the mandrel to form seamless pipe or tubing. The support or stand carrying these rolls is reciprocated through a short stroke in and against the rolling direction, often at high speeds up to 300 strokes/minute.

The common stand or support in which the rolls are journaled is reciprocated in the rolling direction by means of a crank drive. A tie rod has an outer end journaled on the reciprocal roll stand and an inner end eccentrically mounted on a crank arm or wheel that is continuously rotated at the desired stand reciprocation speed. Since the amount of throw is considerable, it is standard to provide counterweights to reduce vibration and strain on the machinery.

Thus, as described in U.S. Pat. No. 5,540,076 based on German 4,336,422 of Baensch and Bonsels, each of two crank arms connected to opposite sides of the roll stand carries a respective counterweight and a common drive motor is connected through respective identical gear trains to the cranks. This is a very large and complex mechanism that is very expensive to build and maintain, and that takes up a great deal of space.

German patent 962,062 of Zeunert employs a vertically effective counterweight. This system requires the base for the roll stand to be very expensively and massively built, as it must accept the vertically moving parts. A big below-ground area must be provided for the drive mechanism.

In German patent 3,613,036, U.S. Pat. Nos. 5,859,458, and 5,076,088 another system is described using planetary type crank drives for compensating out the forces in such a pilger rolling system. Such systems are highly effective, but only work with relatively small systems forming small-bore thin-wall tubing. The machinery becomes extremely large and unwieldy when applied to large rolling stands.

In all the known pilger cold-rolling systems there is the disadvantage that the throw-canceling systems are quite complex and expensive.

OBJECTS OF THE INVENTION

It is therefore an object of the present invention to provide an improved drive for a pilger cold-rolling stand.

Another object is the provision of such an improved drive for a pilger cold-rolling stand which overcomes the above-given disadvantages, that is which is simple and relatively inexpensive.

SUMMARY OF THE INVENTION

A drive for reciprocating a roll stand of a pilger cold-rolling system has according to the invention a crank rotatable about an axis transverse to a reciprocation direction of the stand and a tie rod having an outer end journaled on the stand and an inner and eccentrically journaled on the crank so that rotation of the crank reciprocates the stand in the direction. A compensating weight is fixed to the crank opposite the tie rod and orbits in a weight plane on rotation of the crank. A counterweight is offset along the weight plane from the crank. A drive connects the counterweight to the crank for orbiting the counterweight in the weight plane on rotation of the crank.

Such a drive system is extremely simple, yet operates with minimal vibration and throw.

The pilger roll-stand drive according to the invention has respective shafts carrying the compensating weight and counterweight. The drive includes respective meshing gears fixed to the shafts. A drive shaft carries a gear meshing with the gear of the shaft carrying the counterweight. This drive shaft is the output shaft of a motor or a transmission connected to a motor. The shafts are rotatable about axes that are all coplanar and parallel. Hence all the forces are in a line and basically cancel one another out.

According to a further feature of the invention the stand is centered on the weight plane. In addition the crank can be centered on the weight plane. In the former system the drive has a second crank coaxial with and connected to the first-mentioned crank, a second tie rod having an outer end journaled on the stand and an inner end eccentrically journaled on the second crank, a second compensating weight fixed to the second crank opposite the tie rod and orbiting in a second weight plane parallel to but offset from the first-mentioned weight plane on rotation of the cranks, and a second counterweight offset along the second weight plane from the second crank. The drive also connects the second counterweight to the second crank for orbiting the second counterweight in the second weight plane on rotation of the second crank.

In another system according to the invention the roll stand is centered on a plane symmetrically flanked by the first and second weight planes. The drive can be offset from the planes.

According to another feature of this invention the gears are unitarily formed with the respective weights. The shafts can be horizontal or vertical.

The crank in accordance with the invention has a pin on which the inner end of the tie rod is journaled and that is formed with passages through which a lubricant can be fed.

The masses of the compensating weight(s) and of the counterweight(s) is selected such that they compensate for the first-order stand mass forces during operation of the rolling stand. Such a system is extremely simple. It can be set up and manufactured according to straightforward design practices and very accurately compensates out the vibration and throw produced by the reciprocating roll stand and associated drive parts. The result is virtually no vibration so that the equipment is not hard on its support and surroundings. Its service life will therefore be quite long.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1B:
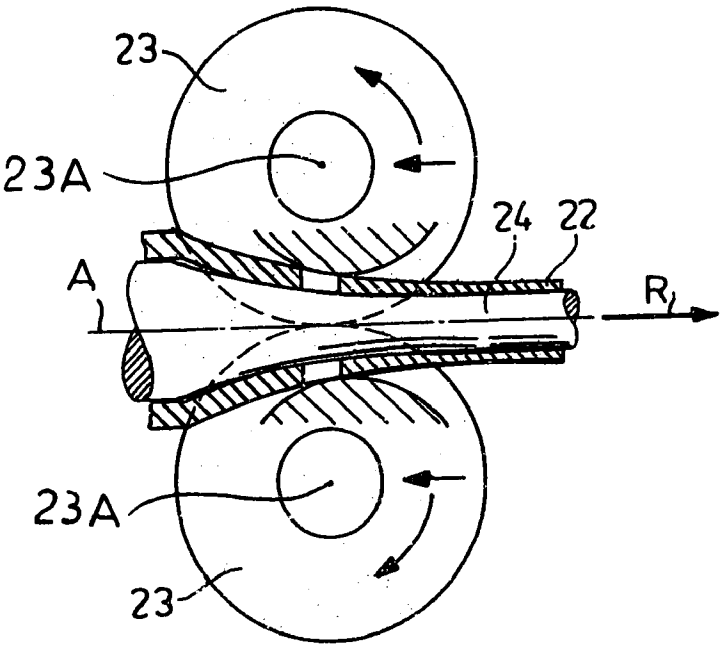
FIGS. 1*a* and 1*b* are schematic side views illustrating a pilger rolling system.
Figure 1A:
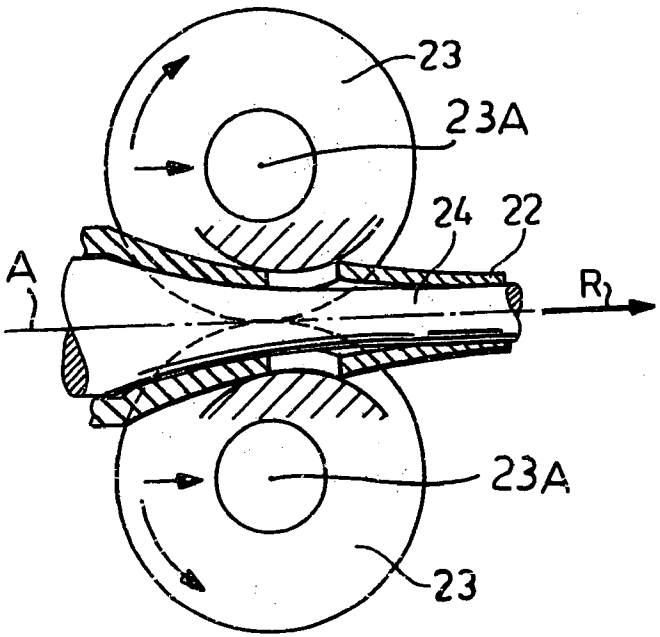

As seen in FIGS. 1*a* and 1*b* a tubular workpiece, here a billet 22, is advanced in a horizontal rolling direction R over a mandrel 24 centered on an axis A of a rolling system 1. Two rolls 23 rotatable about parallel horizontal axes 23A lying in a plane perpendicular to the axis A and parallel direction R are carried in a common frame or stand 2 (FIGS. 2*a* and 2*b*) reciprocated in and against the direction R. Thus as the rollers 23 are reciprocated in the direction R by a crank assembly 4 (FIGS. 2*a* and 2*b*) their rotation directions change as indicated by the unreferenced arrows.

FIG. 2 shows how two parts of the stand 2 symmetrically flank a plane 15 extending parallel to the direction R and axis A and are interconnected by a pivot pin 18 on which is journaled an outer end of a tie or thrust rod 7 whose inner end is journaled on an eccentric pivot pin 19 carried on a crank 5 on a shaft 13 journaled in a stationary housing 3 and carrying diametrically opposite the pin 19 a compensating weight 6.

Two further shafts 12 and 14 are journaled in the housing 3 and centered on axes lying on a horizontal plane 25 with the axis of the shaft 13. The shafts 12, 13, and 14 carry meshing gears 9, 10 and 11 and the shaft 14 is connected to an electric drive motor 28. Another counterweight 8 is carried on the shaft 12 at its end opposite the respective gear 10. The two weights 6 and 8 are centered and lie on a common vertical plane 26 parallel to the plane 15.

Thus as the motor 28 rotates the shaft 14, the shaft 12 and counterweight 8 rotates oppositely to the shaft 14 and the shaft 13 and compensating weight 6 codirectionally to it. Rotation of the shaft 13 causes the pin 19 to orbit about the axis of the shaft 13 and thereby reciprocate the stand 2 horizontally.

With this system therefore the compensating weight 6 and the counterweight 8 are set up such that the first-order mass forces for the system are formed by the roll stand 2 are compensated out by the compensating weight 6 and counterweight 8. Mass forces of second and higher order, which are created by the reciprocation of the stand 2, are not compensated out. Nothing need be done to compensate for the moment that is perpendicular to the horizontal reciprocation direction R of the stand 1 and the perpendicular forces from the weights 6 and 8. The same is true for the other moments because the inertia of the weights 6 and 8 are not aligned to the inertia of the stand 2.

The suggested drive concept thus has somewhat less mass compensation as the solutions of the prior art. This disadvantage is not important on small installations, since the amplitudes of the forces and moments transmitted to the base are small. Only in the case of installations with particularly vibration-sensitive bases are deleterious effects noticed in the surroundings. In this case however the analytical solutions of the known systems and if necessary further compensations are necessary.

Figure 2A:
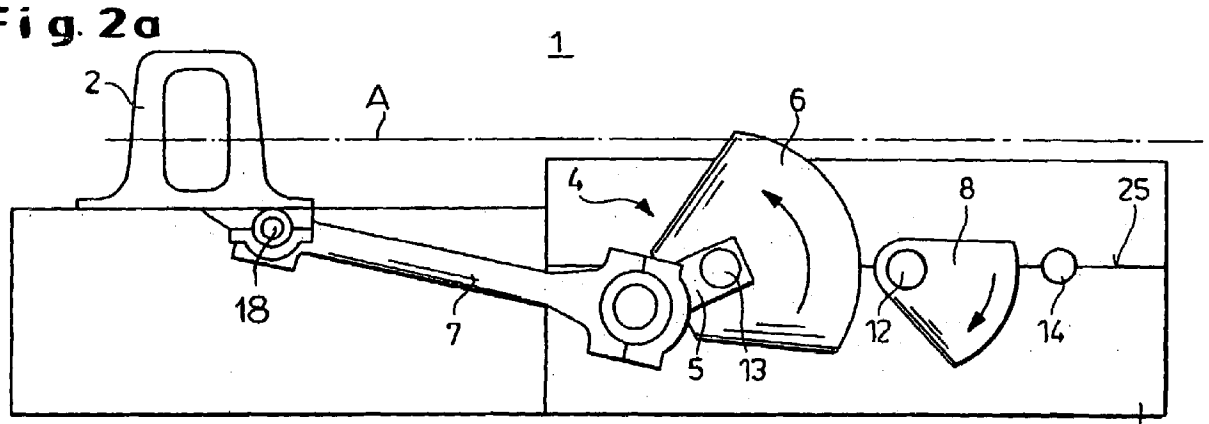
FIGS. 2*a* and 2*b* are side and top sectional views through a first drive according to the invention.
Figure 2B:
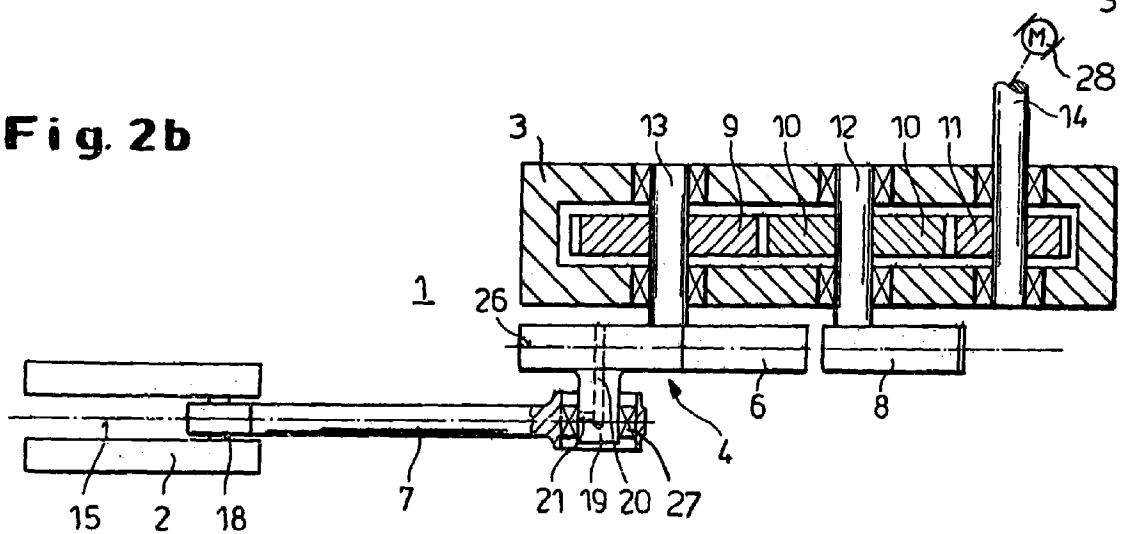

The solution of FIGS. 2*a* and 2*b* with a single thrust rod 7 is particularly effective. The entire crank assembly 4 is aligned with the center plane 15 of the roll stand 2 so that the system is generally horizontally level with this equipment.

In order to supply lubricant to a bearing 27 between the pin 19 and the inner end of the rod 7, the pin 19 is formed with an axial passage 20 and a radial passage 21. Thus lubricant can be fed through these passages 20 and 21 to this bearing 27 even while the machine is operating. A similar system can be provided for the unillustrated bearing on the pivot pin 18. In this manner the lubricant oil can be kept completely separate from any coolant that is used.

Figure 3A:
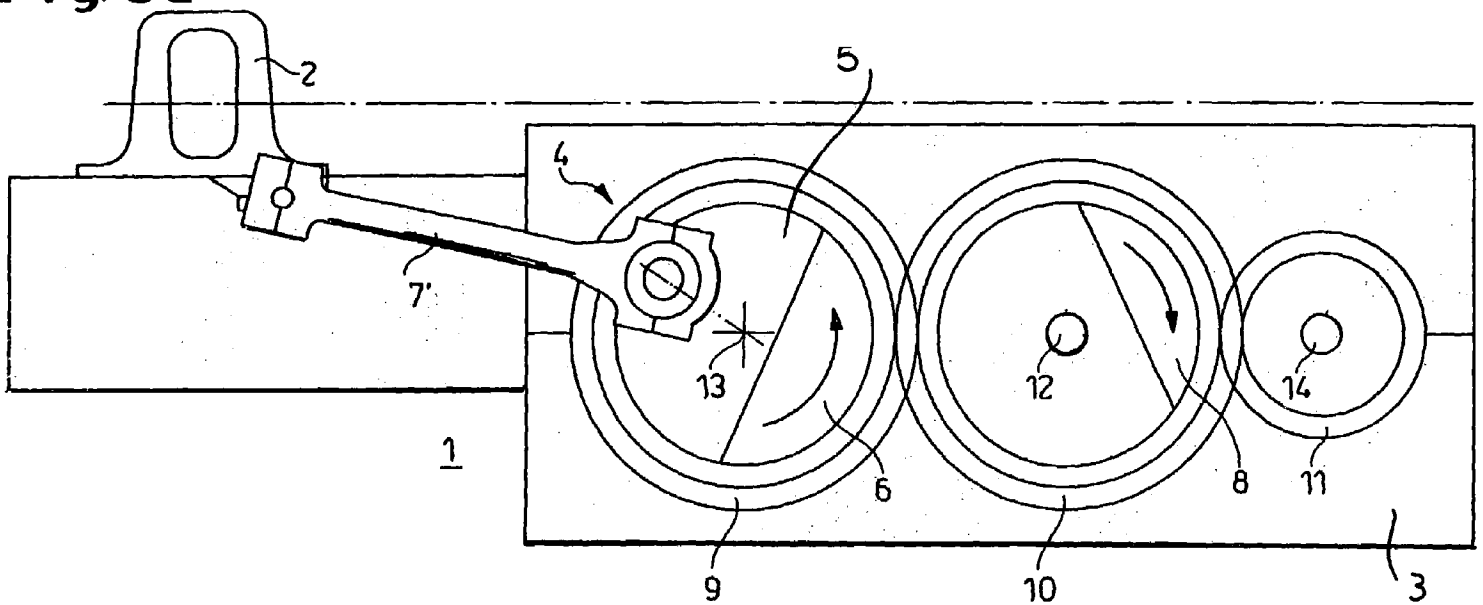
FIGS. 3*a* and 3*b* are views like FIGS. 2*a* and 2*b* through a second drive in accordance with the invention.
Figure 3B:
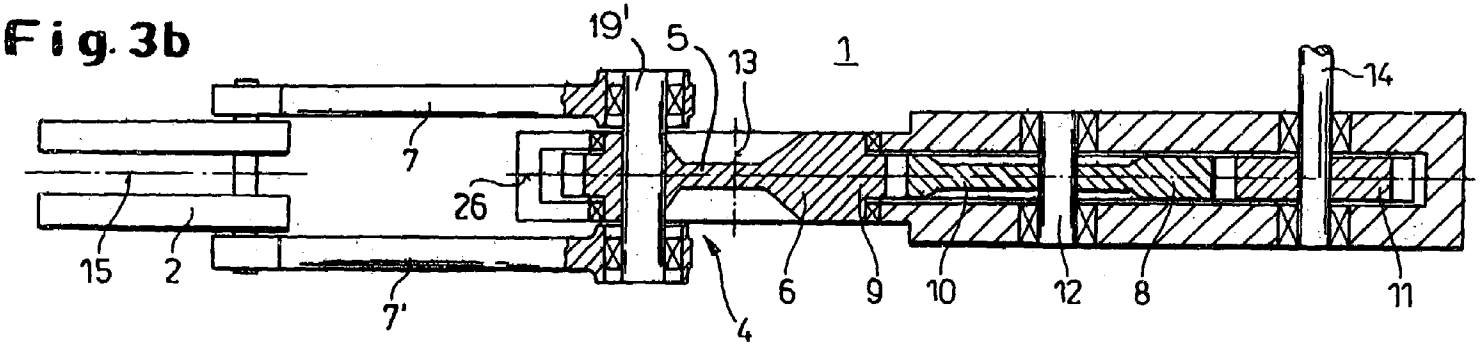

The system of FIGS. 3*a* and 3*b* has a pair of thrust rods 7 and 7' symmetrically flanking the roll-stand plane 15 and connected to opposite ends of a pin 19' projecting from opposite ends of a crank wheel 5 that is integrally formed with the compensating weight 6. Here the crank wheel 5 actually forms the gear 9, the gear 10 is formed with the counterweight 8, and the gears 10 and 11 are all centered on the plane 26 which is coplanar with the plane 5. The gears 9, 10, and 11 are slightly below the path of the strand moving in direction R.

Figure 4A:
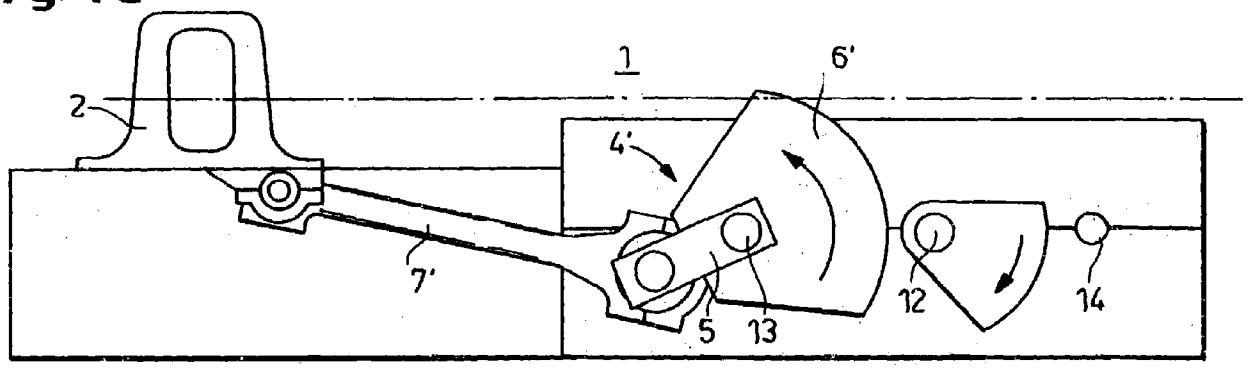
FIGS. 4*a* and 4*b* are views like FIGS. 2*a* and 2*b* through a third drive.
Figure 4B:
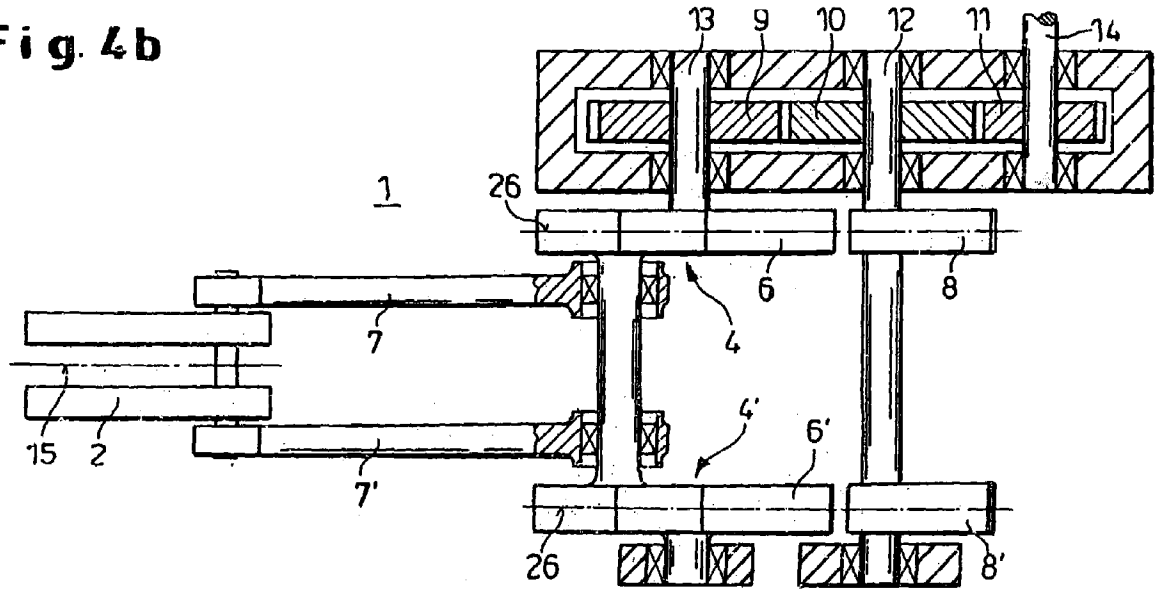

In FIGS. 4*a* and 4*b* there are two crank assemblies 4 and 4' symmetrically flanking the plane 26 and each having respective compensating weights 6 and 6' and counterweights 8 and 8'. The drive assembly constituted by the gears 9, 10, and 11 is offset to one side of the crank assembly 4. Thus the symmetrically arranged weights 6, 6', 8, and 8' completely compensate out the forces on the central plane 15.

Figure 5A:
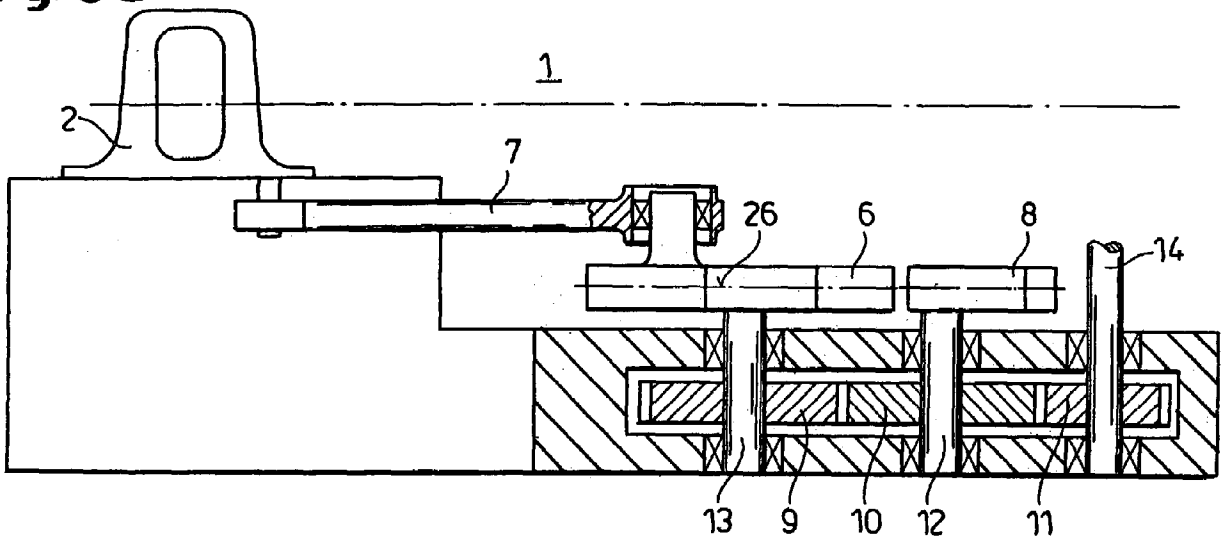
FIGS. 5*a* and 5*b* are views like FIGS. 2*a* and 2*b* through a fourth drive according to the invention.
Figure 5B:
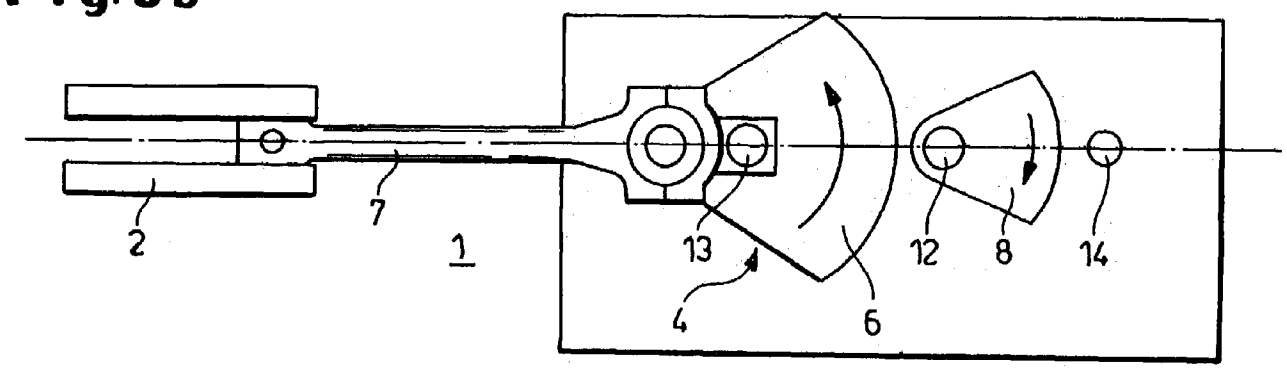

FIGS. 5*a* and 5*b* show an arrangement identical to that of FIGS. 2*a* and 2*b* except that the plane 26 is horizontal and the shafts 12, 13, and 14 are vertical.

I claim:

1. A drive for reciprocating a roll stand of a pilger cold-rolling system, the drive comprising:

a crank shaft defining an axis transverse to a reciprocation direction of the stand;

a crank-shaft gear fixed on the crank shaft and positioned on a weight plane substantially perpendicular to the axis;

a crank on the crank shaft and rotatable therewith about the axis;

a tie rod having an outer end journaled on the stand and an inner end eccentrically journaled on the crank, whereby rotation of the crank shaft reciprocates the stand in the direction;

a compensating weight fixed eccentrically to the crank opposite the tie rod and orbiting in the weight plane on rotation of the crank;

a single counterweight shaft offset along the plane from the crank shaft and substantially parallel thereto;

a counterweight gear fixed on the counterweight shaft and positioned on the weight plane;

a single counterweight fixed eccentrically on the counterweight shaft and offset along the weight plane from the crank, one of the weights being integrally formed with the respective gear; and drive means connected to the counterweight shaft for rotating same and for thereby synchronously orbiting the counterweight and the compensating weight in the weight plane.

2. The pilger roll-stand drive defined in claim 1 wherein the drive means further comprises a drive shaft carrying a gear meshing with the gear of the counterweight shaft.

3. The pilger roll-stand drive defined in claim 2 wherein the shafts are rotatable about axes that are all coplanar and parallel.

4. The pilger roll-stand drive defined in claim 3 wherein the stand is centered on the weight plane.

5. The pilger roll-stand drive defined in claim 3 wherein the crank is centered on the weight plane.

6. The pilger roll-stand drive defined in claim 3, further comprising a second crank coaxial with and connected to the first-mentioned crank;

a second tie rod having an outer end journaled on the stand and an inner end eccentrically journaled on the second crank;

a second compensating weight fixed to the second crank opposite the tie rod and orbiting in a second weight plane parallel to but offset from the first-mentioned weight plane on rotation of the cranks; and a second counterweight offset along the second weight plane from the second crank, the drive means also connecting the second counterweight to the second crank for orbiting the second counterweight in the second weight plane on rotation of the second crank.

7. The pilger roll-stand drive defined in claim 6 wherein the roll stand is centered on a plane symmetrically flanked by the first and second weight planes.

8. The pilger roll-stand drive defined in claim 6 wherein the drive means is offset from the planes.

9. The pilger roll-stand drive defined in claim 3 wherein both of the gears are unitarily formed with the respective weights.

10. The pilger roll-stand drive defined in claim 3 wherein the shafts are horizontal.

11. The pilger roll-stand drive defined in claim 3 wherein the shafts are vertical.

12. The pilger roll-stand drive defined in claim 3 wherein the crank has a pin on which the inner end of the tie rod is journaled and that is formed with passages through which a lubricant can be fed.

13. A drive for reciprocating a roll stand of a pilger cold-rolling system, the drive comprising:

a crank shaft defining an axis transverse to a reciprocation direction of the stand;

a crank-shaft gear fixed on the crank shaft and positioned on a weight plane substantially perpendicular to the axis;

a crank on the crank shaft and rotatable therewith about the axis;

a tie rod having an outer end journaled on the stand and an inner end eccentrically journaled on the crank, whereby rotation of the crank shaft reciprocates the stand in the direction;

a compensating weight unitarily formed with the crank shaft gear and fixed eccentrically to the crank opposite the tie rod and orbiting in the weight plane on rotation of the crank;

a single counterweight shaft offset along the plane from the crank shaft and substantially parallel thereto;

a counterweight gear fixed on the counterweight shaft and position on the weight plane;

a single counterweight unitarily formed with the counterweight gear fixed eccentrically on the counterweight shaft and offset along the weight plane from the crank; and drive means connected to the counterweight shaft for rotating same and for thereby synchronously orbiting the counterweight and the compensating weight in the weight plane.

* * * * *